United States Patent [19]

Smith

[11] 4,119,080

[45] Oct. 10, 1978

[54] HEAT TRANSFER AND CONDITIONING UNIT

[76] Inventor: Robert J. Smith, 4511 E. Snover, Silverwood, Mich. 48780

[21] Appl. No.: 724,774

[22] Filed: Sep. 20, 1976

Related U.S. Application Data

[62] Division of Ser. No. 581,201, May 27, 1975, Pat. No. 3,981,291.

[51] Int. Cl.[2] ..... F24H 3/10

[52] U.S. Cl. ..... 126/110 R; 126/116 R

[58] Field of Search ..... 126/110 R, 110 B, 116 R; 165/135; 122/367 R, 367 C, 155 C

[56] References Cited

U.S. PATENT DOCUMENTS

| | | | |
|---|---|---|---|
| 780,535 | 1/1905 | Steber | 122/155 C |
| 931,422 | 8/1909 | Henzel | 122/155 C |
| 1,611,364 | 12/1926 | Parker | 122/155 C |
| 2,664,861 | 1/1954 | Alexander | 122/155 C |

FOREIGN PATENT DOCUMENTS

| | | | |
|---|---|---|---|
| 10,595 | 11/1927 | United Kingdom | 122/155 C |

*Primary Examiner*—William E. Wayner
*Assistant Examiner*—William E. Tapolcai, Jr.
*Attorney, Agent, or Firm*—Cullen, Sloman, Cantor, Grauer, Scott, & Rutherford

[57] ABSTRACT

A heat transfer and conditioning unit includes a casing overlying a fire chamber. An exhaust conduit is disposed within said casing inwardly of its walls having an inlet to receive heated exhaust gases and an outlet adapted to communicate with a flue to atmosphere. The exhaust conduit includes a series of pairs of opposed parallel laterally elongated plates. Inwardly directed opposed V-formed plates interconnect adjacent plates to define a series of longitudinally spaced laterally elongated venturi passages along the length of said exhaust conduit. Said venturi passages effectively slow down the movement of the products of combustion through the exhaust conduit for increased quantities of heat transfer to the walls thereof. The walls of said exhaust conduit are spaced from the casing to define an independent fresh air heating chamber along the walls of said casing and exhaust conduit for the conductive transfer of heat to the forced fresh air passing therethrough.

5 Claims, 5 Drawing Figures

FIG. 5
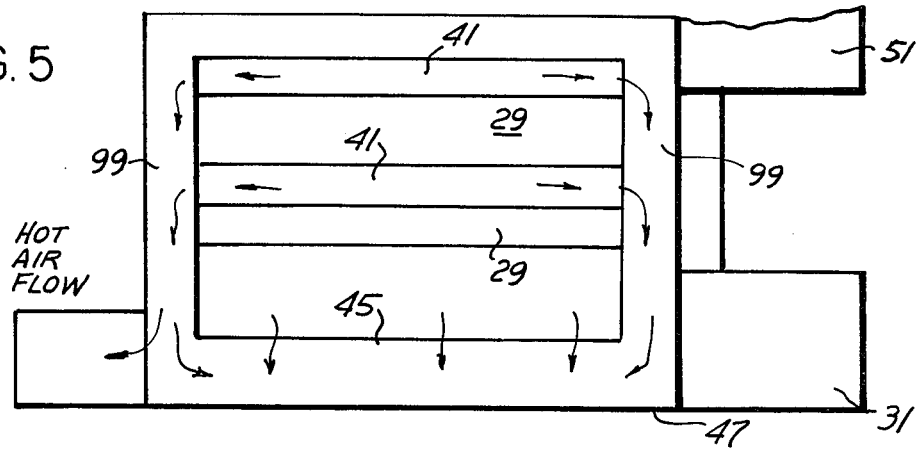
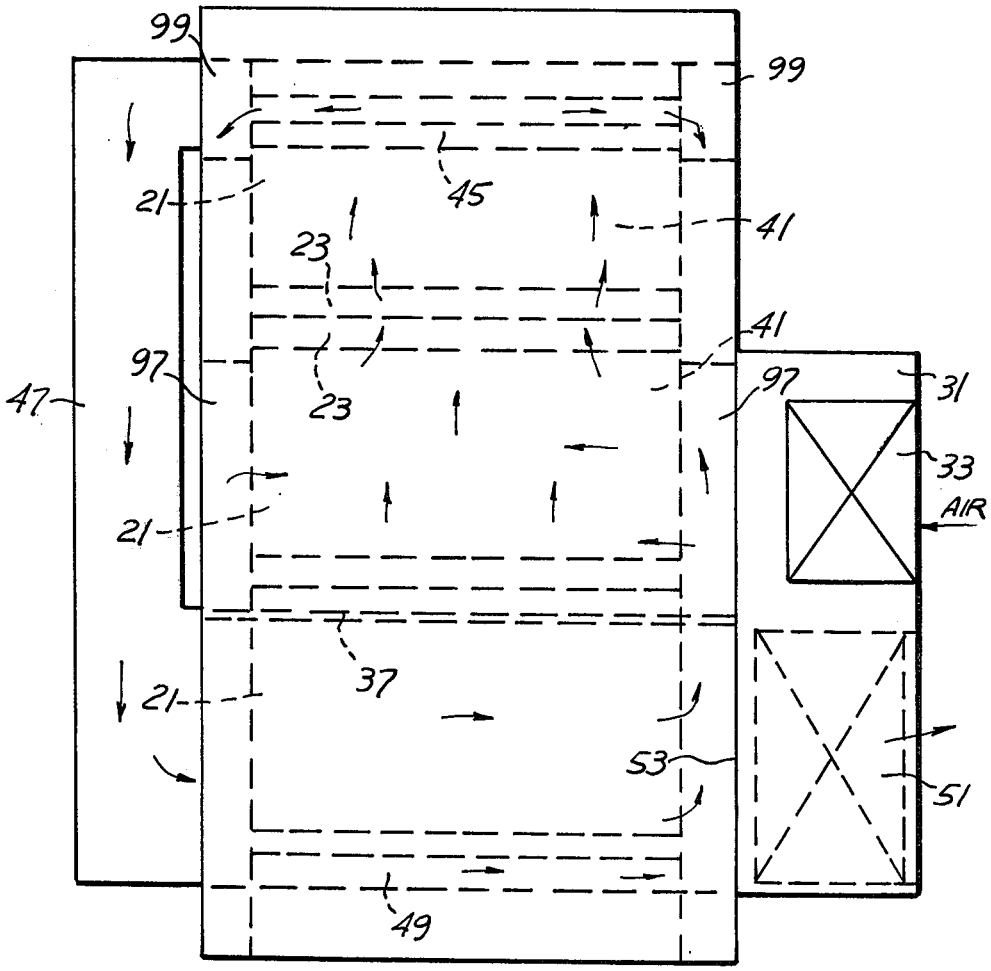
FIG. 4

HEAT TRANSFER AND CONDITIONING UNIT

This application is a division of my copending application, Ser. No. 581,201 filed May 27, 1975, now U.S. Pat. No. 3,981,291.

BACKGROUND OF THE INVENTION

Heretofore, various means have been employed in conjunction with the passage of exhaust gases from a combustion chamber to provide for the efficient transfer of heat to separately partitioned off air chambers which pass through and adjacent such exhaust passages. The main objective, heretofore, was to provide for the most efficient transfer by conduction of heat from the exhaust gases passing through the exhaust passages and through the wall thereof and with respect to fresh air passing through a transversely extending air chamber.

Examples of earlier efforts in this direction are shown in U.S. Pat. No. 1,871,322 and U.S. Pat. No. 3,124,197. Additional examples of earlier efforts to accomplish heat exchange are shown in the following patents: 2,102,727; 101,923; 387,715; 2,307,600; 1,984,949 and 1,161,855.

BRIEF DESCRIPTION OF THE INVENTION

It is an object of the present invention to provide an improved heat exchanger and wherein, the exhaust conduit which transmits the products of combustion is constructed so as to have spaced along the interior thereof, a series of laterally elongated venturi passages. These are designed for slowing down without restriction the product of combustion and, thus, for providing a greater amount of heat transfer from said exhaust gases through the walls of the exhaust passage into separate chambers carrying fresh air or other medium.

It is another object to provide an improved heat transfer and conditioning unit for distributing the products of combustion more evenly and at the same time, slowing down their velocity without restricting passage, for maximum heat transfer through the walls of an exhaust conduit.

It is a further object to provide an exhaust passage, having a cross sectional area of greater size than its inlets and outlets wherein, said inlets and outlets include laterally elongated venturi passages for the slowing down of the products of combustion for the more efficient transfer of heat through an independent adjacent air passage, or other transfer medium.

It is a further object to condition air or end products of combustion, or other conditions that may arise in its practical or apparent application.

These and other objects will be seen from the following specification and claims in conjunction with the appended drawings:

THE DRAWINGS

FIG. 4 is a schematic side elevational view of the heat transfer and conditioning unit of FIG. 1.

FIG. 5 is a fragmentary plan view thereof.

It will be understood that the above drawings illustrate merely a preferred embodiment of the invention, and that other embodiments are contemplated within the scope of the claims hereafter set forth.

DETAILED DESCRIPTION OF THE INVENTION

Figure 1:
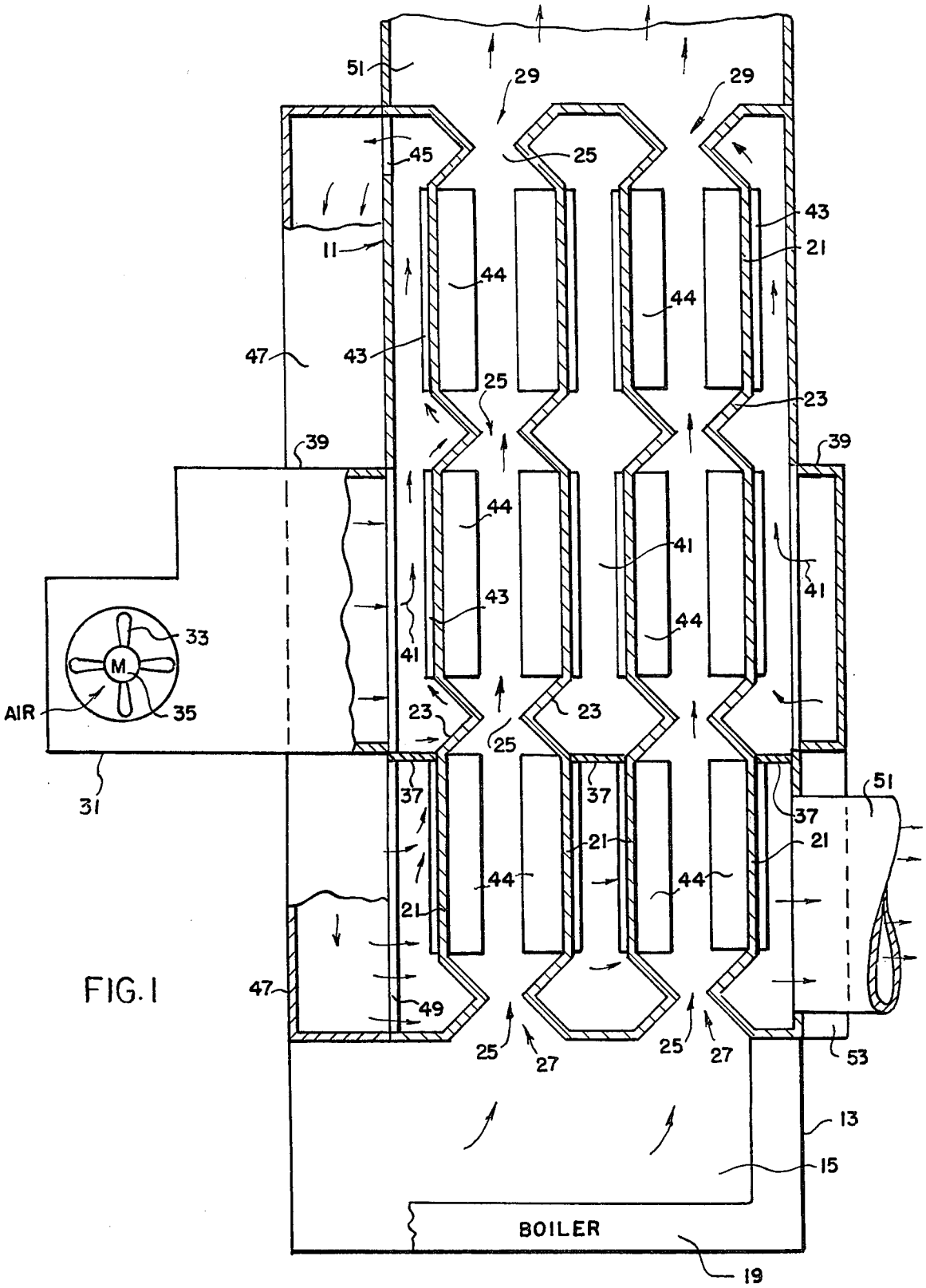
FIG. 1 is a fragmentary schematic elevation view of the present heat transfer and conditioning unit.

FIG. 1 shows schematically one form of the present invention, wherein the heat transfer and conditioning unit includes an upright casing 11 closed at its upper and lower ends and disposed above or adjacent to fire chamber 15 within the fire box 13 which includes a conventional boiler 19, fragmentarily shown. One or more exhaust passages are provided through said casing with exhaust inlet 27 at the lower end thereof, communicating with said exhaust passage and having one or more exhaust outlets at the upper end thereof adapted for communication with a flue to atmosphere.

Said exhaust conduit is defined by a series of pairs of opposed parallel laterally elongated plates 21 arranged in longitudinal alignment. Inwardly directed opposed V-formed plates 23 are arranged at the ends of said parallel plates interconnecting adjacent plates and defining therewith a series of longitudinally spaced laterally elongated venturi passages 25.

The lower-most venturi passages define a pair of exhaust inlets 27, FIG. 1, communicating with the combustion chamber. The upper-most pair of venturi passages define the exhaust outlets 29 adapted for communication to the flue or conventional stack for exhausting to atmosphere.

In the illustrative embodiment, there is shown a pair of exhaust conduits which extend up through said casing. It is contemplated that there could be one or more such exhaust passages for the conduction of products of combustion through said casing.

As schematically shown, there is provided an air intake housing 31 upon said casing which includes blower or impeller 33 operated by motor 35, schematically shown, for the intake of fresh or ambient air from the interior of a room of a building, for example, into a sleeve 39 on or around casing 11 and to define an air inlet 41 within said casing.

A series of longitudinally or laterally extending fins 43 are applied to the exterior surface of the plates 21–23 to provide for an increased and more efficient transfer of heat from the exhaust gases into the chamber upon the exterior of said gas exhaust conduits within said casing. Additional longitudinal fins 44 may be applied to the interior of said plates. Other shapes of exhaust conduit are contemplated, rather than what is shown herein, for illustration.

In the illustrative embodiment, the air inlet 41 through said air pasage is intermediate the ends of said casing and employing suitable baffles 37. The fresh air from inlet 41 passes upwardly as indicated by the arrows to the top of said casing and through the outlet 45 is directed into and downwardly of conduit 47 upon the exterior of said casing. Fresh air from inlet 39 enters the air inlet 41 on the opposite side and the intermediate air inlet 41 through side passages 97, FIG. 4, adjacent baffles 37. The upper ends of said latter air inlets are connected to outlet 45 by top passages 99, FIG. 5.

Said air conduit extends downwardly along the height of said casing, and terminates in an air intake 49 into the lower chambered portion of saidcasing on the exterior of the exhaust conduits 21, as indicated by the arrows, said heated air passes over the walls defining said chamber including the interior wall of the casing and the exterior wall of the lower-most exhaust passage elements to the fresh air outlet 51 delivering heated fresh air to the interior of a room. A suitable sleeve 53 is arranged in conjunction with fresh air intake 49 and fresh air outlet 53 whereby, heated fresh air from the conduit 47 upon the exterior of said casing passes transversely through the casing and over and with respect to the walls of the exhaust conduits defined by plates 21 and 23. Sleeve passages 53 from outlet 49 connect the opposite ends of the hot air chambers defined by the pairs of plates 21 below baffles 37, with hot air outlet 51.

MODIFICATION

Figure 2:
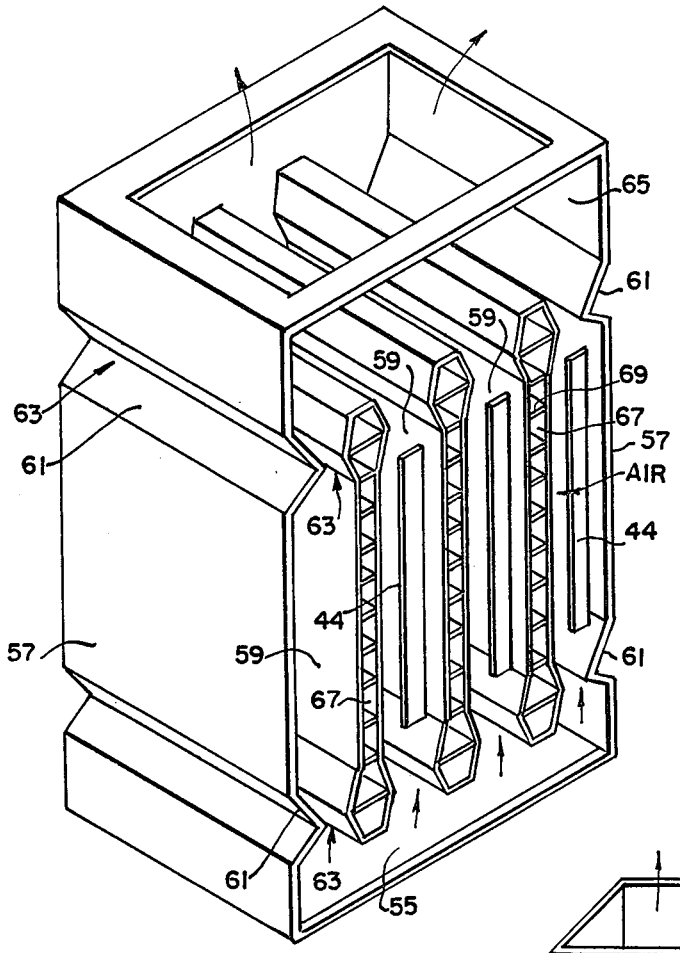
FIG. 2 is a fragmentary perspective view of a modification.

A schematic perspective view of a modification is shown in FIG. 2 which includes a fire chamber 55 and thereabove, a series of parallel spaced laterally elongated opposed plates 57 and 59. The outer plates 57 define the outer wall of the casing for the heat exchanger whereas, the inner opposed parallel plates 59 define a series of transverse laterally elongated fresh air passages 67. These passages have upon their interior walls of series of longitudinally extending fins 69 for a more efficient heat transfer.

The respective plates 57 and 59 at their upper and lower ends terminate in the opposed inwardly directed V-formed laterally elongated plates 61 connected thereto to, thus, define in the illustration shown the series of longitudinally spaced laterally elongated venturi passages 63.

The plates 59 which define the fresh air passages form between said fresh air passages and upon the interior of the outer plates 57 of the casing, a series of parallel spaced exhaust passages with inlets at their lower ends which correspond to the venturi 63 for communication with fire chamber 55. The upper-most venturi passages define a series of exhaust outlets to flue outlet 65 to atmosphere.

The respective air conduits 67 are suitably connected to an air inlet of the type shown at 31, and a suitable exhaust outlet of the type shown at 51, FIG. 1. A suitable forced draft or other air moving means 33 is adapted to deliver fresh air for heating through the conduits 67 or air ducts for picking up heat by conduction from the exhaust gases moving through the exhaust passages between the air conduits and between the air conduits and the respective walls of said casing.

As in the description of FIG. 1, in the embodiment shown in FIG. 2, the series of longitudinally spaced laterally elongated venturi passages 63 are adapted to slow up the normal longitudinal movement of the exhaust gases passing through the exhaust chambers for the more efficient transfer of heat through the walls thereof and for conduction to fresh air passing through air ducts 67.

The manner of circulation of the fresh air may be of a form similar to that schematically shown at 33, FIG. 1.

MODIFICATION

Figure 3:
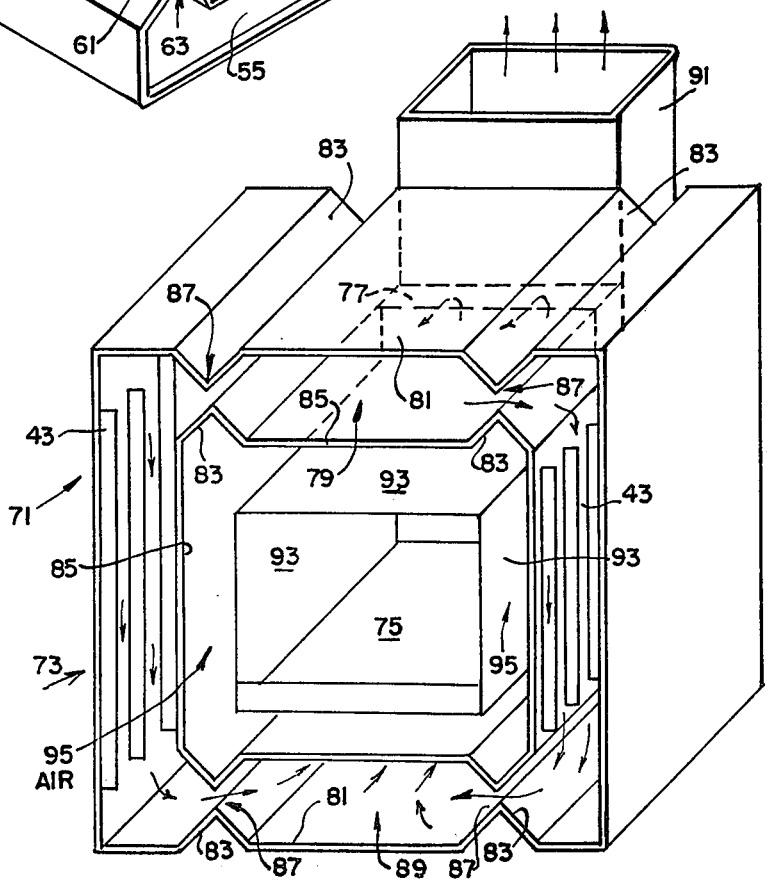
FIG. 3 is a fragmentary perspective view of another modification.

A modified heat exchanger is shown in FIG. 3 and generally designated at 71 as including a hollow double wall upright casing 73. A combustion chamber 75 having an outlet 77 at the top thereof is concentrically nested within said casing, and spaced inwardly from the inner wall 85 of said casing to define the transverse fresh air conduit 95.

The fresh air conduit is adapted to receive fresh air from a room or building to be heated. Said fresh air moves along the walls 93 upon the exterior of the fire chamber and along the interior wall 85 of said casing for the conduction thereto of heat from the products of combustion which are moving within the casing walls 81 and 85.

The casing walls 81 and 85 provide an exhaust intake chamber 79 which is in communication with the fire chamber outlet 77 for the delivery of exhaust gases through the exhaust passageways defined between said casing walls. The hot exhaust gases are passed downwardly upon opposite sides of the fire chamber walls 93 and at the bottom of said casing are directed inwardly through the exhaust outlet chamber 89 and for direction rearwardly to the exhaust flue 91 to atmosphere.

The top and bottom walls of the casing are defined by the parallel laterally elongated plates 81 and 85. At the respective end of said plates which define the exhaust passageway around the combustion chamber, there are provided opposed pairs of oppositely directed V-formed plates 83 connected to the respective plates 81, 85 and to the adjacent portions of the casing walls so as to form within said exhaust passageways a series of longitudinally spaced venturi passages 87.

Said venturi passages are adapted to slow down and evenly distribute the natural movement of exhaust gases which pass from commbustion chamber 75 through outlet 77 into exhaust chamber 79, through the respective venturi passages 87 and downwardly as shown by the arrows between the casing walls 81 and 85.

At the lower ends of said casing, the combustion products are directed inwardly and through the additional sets of venturi passages 87 and into the return exhaust chamber 89 which communicates with the exhaust flue 91 to atmosphere.

Thus, there is a transverse circulation of exhaust gases through the casing walls 81 and 85. At the same time, there is a transverse passage of fresh air to be heated through the air conduit 95 which surrounds the combustion chamber and which is arrnged inwardly of walls 85 of the casing.

A suitable air intake having a blower or impeller, such as shown at 33, FIG. 1, may be employed for communication with fresh air passages 95. Similarly, said fresh air passages will connect with a suitable outlet similar to the outlet 51 shown schematically in FIG. 1.

It has been found that in the use of the present device and the corresponding slowing down of movement of exhaust gases through the respective exhaust passages of the heat exchanger, that there is the result of cooling of said exhaust gases. This results with much of the contaminants therein condensed out and will gravitate and be collected at some point below the exhaust intakes.

This, therefore, results in a treatment of the exhaust gases and for the positive removal of much of the contaminants found therein and including the removal of exhaust solids which are prevented from exhausting to atmosphere.

Having described my invention, reference should now be had to the following claims.

I claim:

1. A heat transfer and conditioning unit comprising a casing closed at its ends;

an exhaust conduit in said casing inwardly of its walls, having a first inlet at one end of said casing adapted to receive heated exhaust gases or products of combustion; and a first outlet at the other end of the casing communicating with a flue to atmosphere;

said exhaust conduit including along its length a series of pairs of opposed parallel laterally elongated plates in longitudinal alignment;

inwardly directed opposed V-formed plates at the ends of said parallel plates interconnecting the adjacent plates and defining therewith a series of longitudinally spaced laterally elongated venturi passage along the length of said exhaust conduit; and further defining the exhaust conduit inlet and outlet; said venturis slowing down movement of and more evenly distributing the products of combustion through said exhaust conduit to said flue, so that increased quantities of heat are transferred to the walls thereof;

the walls of said exhaust conduit being spaced from said casing defining an independent fresh air heating chamber along the walls of said casing and exhaust conduit for the conductive transfer of heat to fresh air passing therethrough;

an inlet to said fresh air heating chamber extending into said casing;

an outlet for said fresh air heating chamber extending from said casing;

and air moving means connected to said air inlet for delivering air into and through said heating chamber, so that said fresh air moves along the walls of said exhaust conduit throughout the length of said casing.

2. A heat transfer and conditioning unit comprising a casing closed at one end and communicating with a fire chamber, and closed at its other end;

an exhaust conduit in said casing inwardly of its walls, having a first inlet at one end of said casing adapted to receive heated exhaust gases; and a first outlet at the other end of the casing communicating with a flue to atmosphere;

said exhaust conduit including along its length a series of pairs of opposed parallel laterally elongated plates in longitudinal alignment;

inwardly directed opposed V-formed plates at the ends of said parallel plates interconnecting the adjacent plates and defining therewith a series of longitudinally spaced laterally elongated venturi passages along the length of said exhaust conduit; and further defining the exhaust conduit inlet and outlet; said venturis slowing down movement of and more evenly distributing the products of combustion through said exhaust conduit to said flue, so that increased quantities of heat are transferred to the walls thereof;

the walls of said exhaust conduit being spaced from said casing defining an independent air heating chamber along the walls of said casing and exhaust conduit for the conductive transfer of exhaust heat to air passing therethrough;

an air inlet to said air heating chamber extending into said casing;

a heated air outlet for said air heating chamber extending from said casing;

and air moving means connected to said air heating chamber inlet for delivering air into and through said heating chamber, so that said air moves along the walls of said exhaust conduit throughout the length of said casing, and through said heated air outlet.

3. In thc heat transfer unit of claim 2, said air inlet being located intermediate the ends of said casing;

said air heating chamber having an outlet intermediate its ends adjacent said other end of said casing;

baffle plates in said air heating chamber between said casing and exhaust conduit plates, whereby air is delivered from said air inlet in one direction to said other end of the same casing and to said intermediate outlet;

and an elongated conduit on and along the exterior of said casing at one end connected to said intermediate outlet and at its other end, connected to said casing, adjacent its one end and having an outlet to said air heating chamber, for delivering air over the remainder of the walls of said exhaust conduit and su

4. In the heat transfer unit of claim 2, said air moving means being a motor operated impeller.

5. In the heat transfer unit of claim 2, longitudinally or laterally extending fins along the exterior surface of said exhaust conduit for improved heat transfer to the moving fresh air.

* * * * *